US007617938B2

(12) United States Patent
Zhao et al.

(10) Patent No.: US 7,617,938 B2
(45) Date of Patent: Nov. 17, 2009

(54) ELASTIC SIEVING TECHNIQUE AND CORRESPONDING LARGE-SIZED ELASTIC VIBRATION SCREEN

(75) Inventors: Yuemin Zhao, Jiangsu (CN); Chusheng Liu, Jiangsu (CH); Chengyong Zhang, Jiangsu (CH)

(73) Assignee: China University of Mining and Technology, Jiangsu (CN)

( * ) Notice: Subject to any disclaimer, the term of this patent is extended or adjusted under 35 U.S.C. 154(b) by 440 days.

(21) Appl. No.: 11/529,620

(22) Filed: Sep. 28, 2006

(65) Prior Publication Data

US 2007/0261999 A1 Nov. 15, 2007

(30) Foreign Application Priority Data

May 9, 2006 (CN) ..... 2006 1 0040135

(51) Int. Cl.
*B07B 1/28* (2006.01)

(52) U.S. Cl. ..... 209/309; 209/275; 209/276; 209/326; 209/346; 209/347

(58) Field of Classification Search ..... 209/275, 209/276, 326, 346, 347, 309
See application file for complete search history.

(56) References Cited

U.S. PATENT DOCUMENTS 2,831,576 A * 4/1958 Wehner ..... 209/365.3
3,179,251 A * 4/1965 Werner ..... 209/325
3,954,604 A * 5/1976 Krause et al. ..... 209/325
4,355,647 A * 10/1982 Heidjann et al. ..... 460/91
5,595,306 A * 1/1997 Hukki et al. ..... 209/325
6,845,868 B1 * 1/2005 Krush et al. ..... 209/365.4

(Continued)

FOREIGN PATENT DOCUMENTS

CN 97107249.3 12/1997

(Continued)

*Primary Examiner*—Patrick H Mackey
*Assistant Examiner*—Terrell H Matthews
(74) *Attorney, Agent, or Firm*—Patterson, Thuente, Skaar & Christensen, P.A.

(57) ABSTRACT

An elastic sieving method and corresponding large-sized elastic vibration screen. The present invention utilizes a screening surface and a separate sieving machine. A screen mat located on the sieve box is connected to multiple small rectangular screens. While the machine is vibrating, the resonation of screen rods located on the screen mat connected by small rectangular screens are initiated to screen the material and to cause the vibration of the whole vibration screen and realize the conveyance and lamination of materials. Because the screening surface is in a state of resonance, the vibration strength is strong enough to prevent the screen meshes from becoming plugged, allowing for high sieving efficiency. A bearing in the sieving mechanism is installed with a vibration damping ring, placing the bearing in a resonant state, allowing for a low dynamic stress level, which satisfies the process requirement for large-sized vibration screen excitation units with a screening surface as wide as 4800 mm. Thus, the production efficiency of vibration screen is high, the structure of the machine is simple and easy to repair and maintain, and energy consumption is reduced. Furthermore, the dynamic stress level of the sieving machine is low, the reliability is high, and the vibrations are stable. These properties allow the present invention to have a wide range of practical applications, including uses in the coal, metallurgic, chemical and environmental protection fields.

8 Claims, 2 Drawing Sheets

U.S. PATENT DOCUMENTS

| | | | | |
|---|---|---|---|---|
| 7,195,121 | B2 * | 3/2007 | Anibas | 209/344 |
| 2005/0072717 | A1 * | 4/2005 | Purohit et al. | 209/309 |
| 2006/0210456 | A1 * | 9/2006 | Bruggendick | 422/176 |
| 2007/0158244 | A1 * | 7/2007 | Puda et al. | 209/309 |

FOREIGN PATENT DOCUMENTS

| | | |
|---|---|---|
| CN | 00253302.2 | 12/2000 |
| CN | 02219584.X | 3/2002 |
| CN | 02211871.3 | 5/2002 |

* cited by examiner

ELASTIC SIEVING TECHNIQUE AND CORRESPONDING LARGE-SIZED ELASTIC VIBRATION SCREEN

RELATED APPLICATION

The present application claims priority to Chinese Application No. 200610040135.6 filed May 9, 2006.

TECHNICAL FIELD

This invention relates to an elastic sieving technique and a corresponding large-sized elastic vibration screen, especially adaptable for dry separation with a large-sized vibration screen used in coal separating plants, as well as dry separation with other types of vibration screens.

BACKGROUND OF THE INVENTION

Vibration screens used for coal separation have become absolutely necessary equipment for coal separating plants. Rapid wear of vibration screens and plugging of sieves, however, occur frequently. At present there are many types of vibration screens being used. Chinese Patent No. 97107249, entitled "Multiple Freedom Elastic Collision Type Screen Mat and Corresponding Sieving Technique" discloses an elastic rod and multiple freedom collision type screen mat and a corresponding sieving technique adaptable for dry sieving fine, particle-sized materials. The disclosed invention consists of many screen threads fixed on a screen mat frame, with the screen threads and frame holes clearance fit. The screen threads collide into a frame wall causing an instantaneous acceleration effect at the time of collision. The flowing of materials onto the screen surface causes the screen threads to continuously self clean, improves the loose effect of materials, increases sieving efficiency and lower limit of classification. As time passes, however, the holes in the screen become plugged, causing the frame to be unable to self clean. Chinese Patent No. 00253302, entitled "Dual Plastid Independently Supported Dual Drive Remittent Screen," discloses an elastic screen mat mounted on a beam of an internal and external sieve box to produce a tensing and relaxing sieving motion. The screening surface allows for a large acceleration, is not easily plugged, and can be widely applied to material screening of metallurgic, mine, coal, building material, municipal garbage, and wastewater cleaning fields. Rapid wear of screening surface, however, is significant weak point of screen. Chinese Patent No. 02211871, entitled "Dual Vibration Large-Sized Round Vibration Screen," discloses a large-sized round vibration screen with dual vibrators. The invention discloses a round vibration screen with two vibrators that rotate in parallel and have eccentric shafts of identical mass. The two vibrators move continuously and synchronistically through a tooth belt connection. If the vibrators are not increased in size, however, while the vibration strength of vibration screen is improved, the structure is too complicated, the manufacturing cost is high, and the energy consumption is huge. Chinese Patent No. 02112809, entitled "Hyperstatic Net Girder Excitation Large-Sized Vibration Screen," discloses a hyperstatic net girder unit installed between the screen plates on two sides of the sieve box. The invention uses at least one piece of a hyperstatic support plate to connect multiple main girders and form into a container, and includes a vibration exciter on the vibration drive shaft on two sides of the hyperstatic support plate. As a result, the comprehensive properties are improved and the vibration is stable and can satisfy the process requirement of large-sized vibration screen, but the structure of machine is complicated, the mass participating in the vibration is big, and the energy consumption is huge.

SUMMARY OF THE INVENTION

The purpose of the present invention is to provide an elastic sieving technique and corresponding large-sized elastic vibration screen that increases the intensity of screen surface vibrations by utilizing its own elastic resonance, thereby solving numerous problems, including plugged screen meshes, rapid wear of screen surfaces, complicated structures, large mass of vibration, and high energy consumption. The present invention will also reduce the integral dynamic stress of sieving machines and allow for larger-sized sieving machines.

This invention is an elastic sieving technique. The screen mat on the sieve box is connected by multiple small rectangular screens and utilizes the resonance of the whole machine while also using the resonance of screen rods on the screen mat connected by small rectangular screens. The screen rods are then initiated to screen the material and cause the vibration of the entire vibration screen to realize the conveyance and lamination of materials.

The large-sized elastic vibration screen mentioned in this invention, elastic sieving technique, comprises a power driven system, a front elastic support, a back elastic support, a sieve box fixed on both the front and back elastic supports, and a vibration exciter installed on the sieve box. A screen mat located on the sieve box consists of multiple small rectangular screens. Sieve rods located on the front segment screen surface of the screen mat consist of rectangular screens having longer distances between each sieve rod, while those on the back segment of the screening surface of the screen mat have shorter distances between each sieve rod. A vibration damping ring is located between a bearing and a shaft inside the bearing support of vibration exciter. The rectangular screen consists of a flute form beam, a baffle, and sieve rods mounted in the flute form beam. A constrained rod is located between every two sieve rods, and polyurethane elastomer inside the flute form beam. Multiple cantilevered vibration damping sheets are located in the inner loop of the vibration damping ring.

By utilizing the technique of separating the screening surface and sieving machine and adopting a combination of multiple small rectangular screens, the present invention can utilize the small vibration strength of the sieving machine body and the large vibration strength of the screen surface. The vibration strength of the sieving machine body is only used to provide the energy necessary for material conveyance and lamination, thus reducing power consumption, saving energy, maintaining high reliability, and reducing the dynamic stress on the sieving machine. Because the screen surface is in a resonant state and the vibration strength is large, the screen meshes are not likely to become plugged, allowing for high screening efficiency. The key component of the screening mechanism is a bearing equipped with a vibration damping ring which puts the bearing in non-resonating state, so the level of dynamic stress is very low and can satisfy the process requirement of large-sized vibration screen excitation units with a screen surface of 7 m long and 4.8 m wide. The integral vibration strength is relatively small, which is smaller than the conventional design value 3.3 g. The self elastic vibration strength of the screen surface will provide the energy for complete material screening. Because the vibration strength of screen rods may be designed for a large value, which can reach 50 g and greater, the obstacle of screen mesh plugging is overcome, the screening efficiency of the screen surface is increased, and the requirement of the sieving process is satisfied. Furthermore, the production efficiency of the sieving machine is increased, the structure of the integral machine is simple and easy to repair and maintain, the machine has strong comprehensibility and stable vibration, and the machine has a wide range of practical applications, including uses in the coal, metallurgic, chemical and environmental protection fields.

BRIEF DESCRIPTION OF THE DRAWINGS

The invention may be more completely understood in consideration of the following detailed description of various embodiments of the invention in connection with the accompanying drawings, in which.

Figure 1:
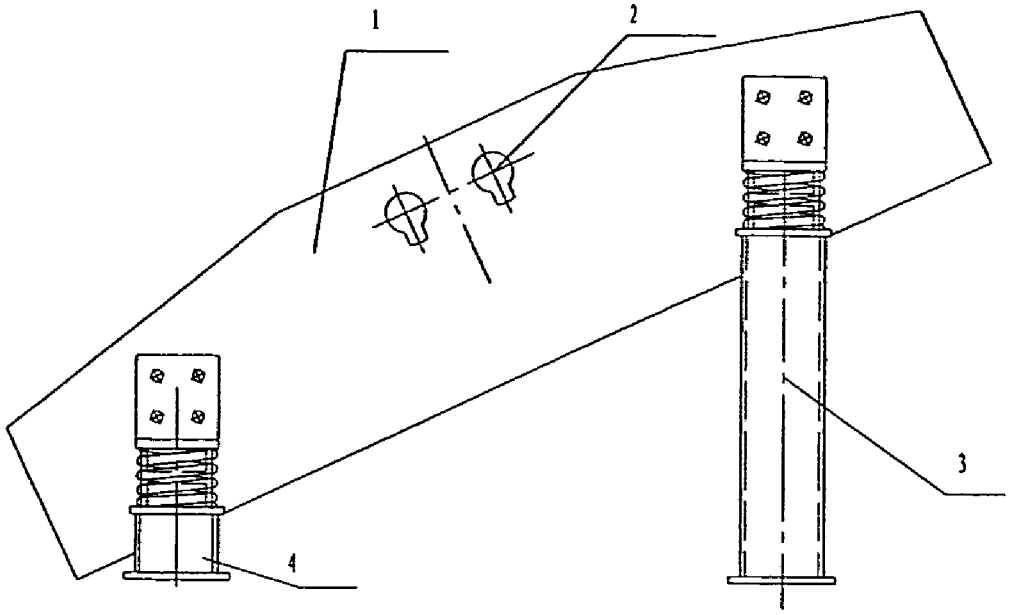
FIG. 1 is a front view of structure of the elastic vibration screen.
Figure 2:
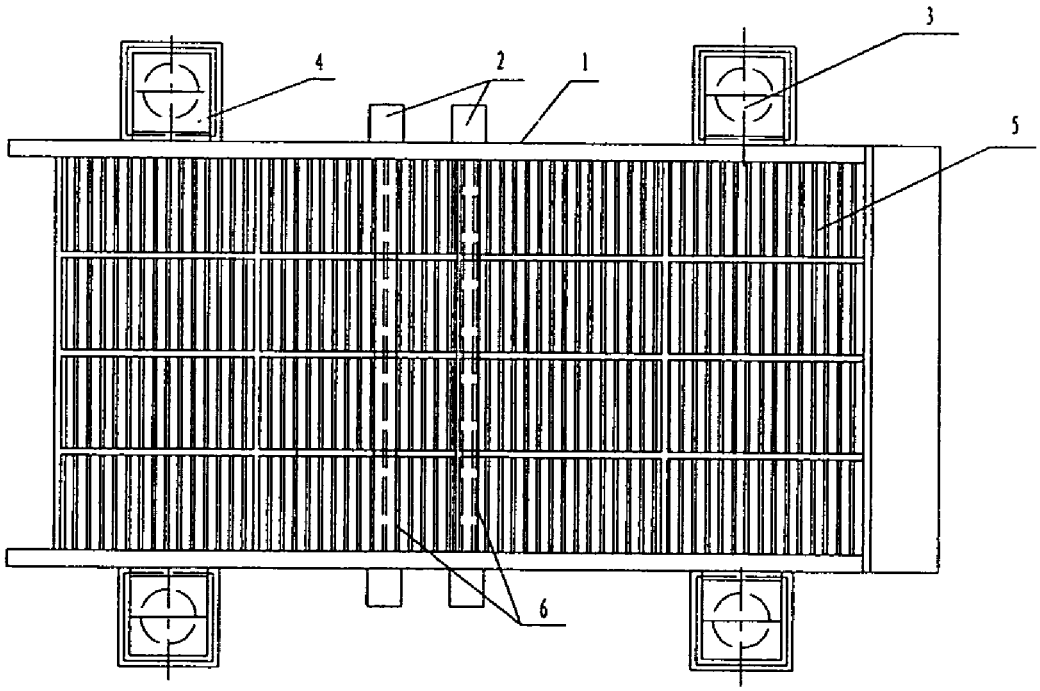
FIG. 2 is a top view of structure of the elastic vibration screen.
Figure 3:
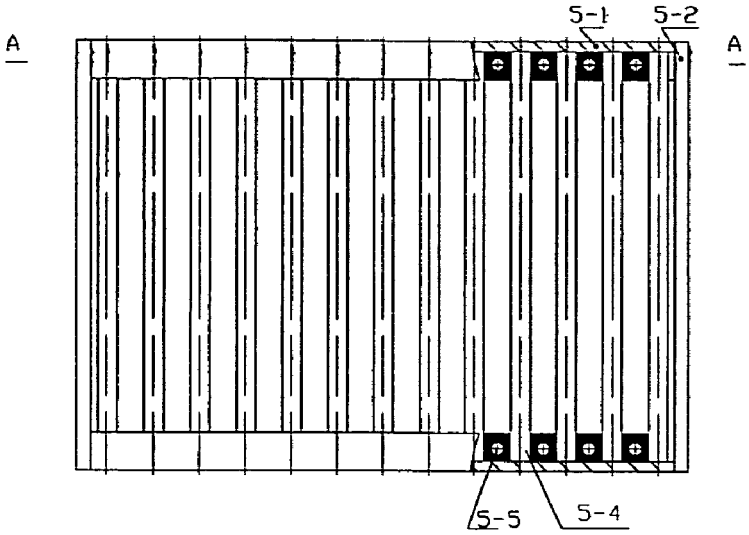
FIG. 3 is a structural drawing of small rectangular screens.
Figure 4:
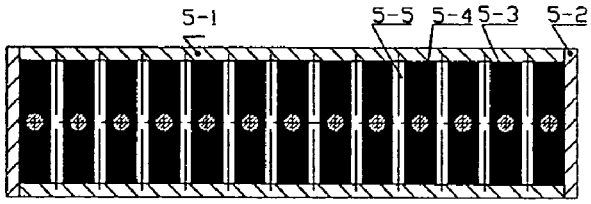
FIG. 4 is a sectional view along the line A-A view of FIG. 3.
Figure 5:
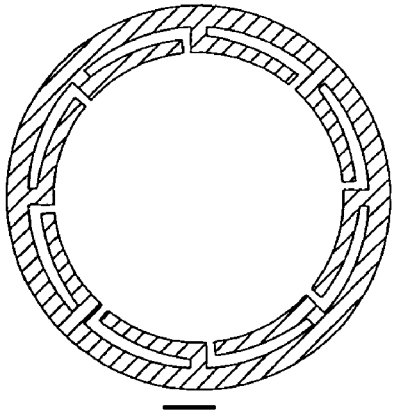
FIG. 5 is a structural drawing of a vibration damping ring.

In these figures, 1—Sieve box; 2—Vibration exciter, 3—Back support; 4—Front support; 5—Small rectangular screens; 6—Vibration exciting beam; 5-1—Cross beam; 5-2—Baffle; 5-3—Elastomer, 5-4—Sieve rods; 5-5—Constrained rod.

DETAILED DESCRIPTION OF THE INVENTION

The present invention is an elastic sieving technique that can realize the lamination of materials through integral motion of a sieving machine and complete screening through vibrations of a screen surface. The screen mat on the sieve box 1 is connected to multiple small rectangular screens 5, utilizing integral vibrations of the sieving machine. The resonance of screen rods on a screen mat connected by small rectangular screens is initiated to screen the materials completely. The integral vibration comprising primary vibration of a machine body and a secondary vibration of the screen mat connected by small rectangular screens can aid in the conveyance and lamination of materials. Namely, adopting the technique of separating the vibration of the sieving machine and the vibration of the screen surface, the screen mat is placed in the screen surface with sieve rods supported by elastomer. The screen surface may vibrate vertically against the sieving machine body, but the elastic screen surface prevents horizontal vibration. The sieve rods resonate during the vibration of the sieving machine. In theory, the vibration strength of the screen surface is infinite, but the vibration strength of the sieving machine body is relatively small. The sieve rods and sieve flame are cast into an integral body with special elastic material. The scleroscope hardness of the elastic material can range between 25~40 A. The working rotation rate of the sieving machine is designed as the basic frequency of the screen surface, which may cause the resonance of the screen surface, so the screen surface will vibrate at a higher strength and the sieving machine body will vibrate at a lower strength and realize the sieving technique of high vibration amplitude and large vibration strength of the screen surface while guaranteeing the reliability of the sieving machine.

The elastic vibration screen used in this invention comprises a power driven system, a front elastic support 4, a back elastic support 3, a sieve box 1 fixed on both front and back elastic supports, a vibration exciter 2 mounted on the sieve box 1, and a screen mat on the sieve box 1. The screen mat comprises multiple small rectangular screens 5 where the number of rectangular screens 5 is determined by the length and width of the sieve box—the longer and wider the sieve box is, the larger the number is, and vice versa. If the screen surface is 7 m long and 4.8 m wide, the size of rectangular screen 5 is set as 1×0.6 m, and the number rectangular screens is 56. Single rectangular screens 5 comprise a flute form beam 5-1, a baffle 5-2, and a sieve rod 5-4 mounted in the flute form beam 5-1. There is a constrained rod 5-5 between every two sieve rods 5-4, and there is polyurethane elastomer 5-3 located inside the flute form beam 5-1. Sieve rods 5-4 are fixed along the longitudinal direction of screen surface, but they may vibrate along the vertical direction of screen surface against the flute form beam 5-1. As materials are vibrated along the longitudinal direction of the screen surface it can be difficult to screen materials at the front segment of screen surface because there may be too many materials accumulated there and there are fewer materials at the back segment of screen surface. As a result, the middle segment of the screen surface has the highest probability of successfully screening the materials. Therefore, the present invention sets the distance between every two sieve rods to be the largest at front segment of the screen surface and the smallest at back segment. Intermediate sized sieve rods are located in the middle segment, so the width between sieve rods changes along the longitudinal direction of the screen surface. That is to say, the distance between every two sieve rods at middle segment of screen surface of a screen mat that consists of rectangular screens 5 is shorter than that at the front segment of the screen surface but longer than that at the back segment of the screen surface. The distance between two sieve rods of different segments of screen surface may be arranged according to the actual demand, where the ratio of these distances at front, middle and back segments may be 1.1:1:0.9. The vibration exciter 2 located on the sieve box 1 is connected to the wall of sieve box 1 with the vibration excitation rod 6. There is a vibration damping ring located between a bearing and a shaft inside the bearing support of vibration exciter 2. Numerous of cantilevered vibration damping sheets are located along the internal loop of the vibration damping ring. The cantilevered beam of the vibration damping ring is variably rigid, capable of restraining various harmonious waves and placing the bearing at a lower level of vibration to effectively reduce the dynamic stress level of sieving machine. The dynamic parameter, the ratio of vibration amplitude between sieve rods and the sieving machine, is 5:1, so the vibration strength of the screen surface is at least five times that of conventional vibration screens. The elastic material can be filled and cast according to specific arrangements of screen surfaces.

The invention claimed is:

1. An elastic screening technique comprising:

providing a screen mat having a screen mat surface and connected by multiple small rectangular screens to a sieve box, wherein each of the multiple rectangular screens comprises a plurality of sieve rods, a sieve frame, and an elastic sieve rod support material having a scleroscopic hardness ranging from 25 to 40 A, and the multiple rectangular screens are cast into an integral body;

placing materials required to be screened on the screen mat surface, and utilizing vibrations from a vibrating machine to resonate the sieve rods of the screen mat to allow for the screening of the material, such that a work rotation rate of the sieving machine is a basic frequency of the screen mat surface.

2. A large-sized elastic vibration screen comprising:

a power driven system;

front elastic support;

back elastic support;

a sieve box fixed on the front and back elastic supports;

a screen mat operably connected to the sieve box, the screen mat comprising multiple rectangular screens, each of the multiple rectangular screens including sieve rods supported in an elastic material;

a vibration exciter mounted on the sieve box within the screen mat;

a vibration damping ring located between a bearing and a shaft inside the bearing support of the vibration exciter; and wherein the vibration exciter is configured to rotate at a rate that is a basic frequency of a screen surface of the screen mat, such that the sieve rods will vibrate substantially at resonance, and the vibration damping ring is configured to isolate the bearing from vibration of the screen mat such that a vibration level of the bearing is less than a vibration level of the screen mat.

3. The large-sized elastic vibration screen mentioned as described in claim 2, said rectangular screens comprising a flute form beam, a baffle, and sieve rods mounted in the flute form beam, where a constrained rod is located between every two sieve rods and polyurethane elastomer is located inside the flute form beam.

4. The large-sized elastic vibration screen as described in claim 2, where multiple cantilevered vibration damping sheets are installed in the inner loop of said vibration damping ring.

5. A large-sized elastic vibration screen comprising:

a power driven system;

front elastic support;

back elastic support;

a sieve box fixed on the front and back elastic supports;

a screen mat operably connected to the sieve box, the screen mat including multiple rectangular screens, said rectangular screens comprising a flute form beam, a baffle, and sieve rods mounted in the flute form beam, wherein a constrained rod is located between every two sieve rods, polyurethane elastomer is located inside the flute form beam, and sieve rods located on a front segment of the screening surface of the screen mat with rectangular screens have a longer distance between each rod, while sieve rods on the back segment of screening surface of the screen mat have a shorter distance between each sieve rod;

a vibration exciter mounted on the sieve box within the screen mat; and a vibration damping ring located between a bearing and a shaft inside the bearing support of the vibration exciter.

6. The large-sized elastic vibration screen as described in claim 5, wherein multiple cantilevered vibration damping sheets are installed in the inner loop of said vibration damping ring.

7. The elastic vibration screen of claim 2, wherein sieve rods located on a front segment of a screening surface of the screen mat with rectangular screens have a longer distance between each rod, while sieve rods on the back segment of the screening surface of the screen mat have a shorter distance between each sieve rod.

8. The elastic vibration screen of claim 2, wherein the elastic material has a scleroscopic hardness in the range of 25 to 40 A.

* * * * *

UNITED STATES PATENT AND TRADEMARK OFFICE

CERTIFICATE OF CORRECTION

PATENT NO. : 7,617,938 B2
APPLICATION NO. : 11/529620
DATED : November 17, 2009
INVENTOR(S) : Zhao et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 490 days.

Signed and Sealed this

Nineteenth Day of October, 2010

David J. Kappos

David J. Kappos
*Director of the United States Patent and Trademark Office*